US010526048B2

(12) United States Patent
Dane et al.

(10) Patent No.: US 10,526,048 B2
(45) Date of Patent: Jan. 7, 2020

(54) MAST BASE ASSEMBLY

(71) Applicant: Solar Sailor Pty Ltd, New South Wales (AU)

(72) Inventors: Robert Dane, Middle Cove (AU); Graeme Johnston, New South Wales (AU)

(73) Assignee: SOLAR SAILOR PTY LTD., New South Wales (AU)

( * ) Notice: Subject to any disclaimer, the term of this patent is extended or adjusted under 35 U.S.C. 154(b) by 0 days.

(21) Appl. No.: 16/329,114

(22) PCT Filed: Jul. 20, 2017

(86) PCT No.: PCT/AU2017/050747

§ 371 (c)(1),
(2) Date: Feb. 27, 2019

(87) PCT Pub. No.: WO2018/039705

PCT Pub. Date: Mar. 8, 2018

(65) Prior Publication Data

US 2019/0233056 A1 Aug. 1, 2019

(30) Foreign Application Priority Data

Aug. 30, 2016 (AU) ..... 2016903440

(51) Int. Cl.
*B63B 15/00* (2006.01)
*B63H 9/06* (2006.01)

(52) U.S. Cl.
CPC ..... *B63B 15/00* (2013.01); *B63B 15/0083* (2013.01); *B63H 9/0607* (2013.01); *B63B 2015/0058* (2013.01)

(58) Field of Classification Search
CPC ..... B63B 15/00; B63B 15/0083; B63B 2015/0058; B63H 9/0607
See application file for complete search history.

(56) References Cited

U.S. PATENT DOCUMENTS 5,421,555 A * 6/1995 Sims ..... B60D 1/66 254/420
5,493,988 A * 2/1996 Kollberg ..... B63H 9/1028 114/106

(Continued)

FOREIGN PATENT DOCUMENTS

WO 1998021089 A1 5/1998

OTHER PUBLICATIONS

Notification of Transmittal of International Preliminary Report on Patentability (Re-Issue) issued in corresponding PCT application No. PCT/AU2017/050747 dated Jan. 7, 2019, 4 pages.

(Continued)

*Primary Examiner* — Stephen P Avila
(74) *Attorney, Agent, or Firm* — Weber Rosselli & Cannon LLP

(57) ABSTRACT

The present invention is directed broadly to a marine vessel (10) comprising a deck (12) mounted to a hull (14) together with a sail (16) coupled to the marine vessel (10) via a mast base assembly (18). The mast base assembly (18) comprises a mast tilt assembly (22). The mast base assembly (18) also comprises a mast base mounting (20) to which the mast tilt assembly (22) is pivotally mounted for movement about a tilt axis (24) between stowed and operative positions. The mast base assembly (18) further comprises a sail slew assembly (26) mounted to the sail (16) associated with the marine vessel (10). The sail slew assembly (26) is operatively coupled to the mast tilt assembly (22) for slewing of the sail (16). The sail (16) is rotated or slewed about a slew axis (28) of the mast tilt assembly (22) to reorient the sail (16) relative to the marine vessel (10).

18 Claims, 10 Drawing Sheets

(56) References Cited

U.S. PATENT DOCUMENTS

| | | | | |
|---|---|---|---|---|
| 2011/0030544 | A1* | 2/2011 | Hodge | F41A 27/06<br>89/41.05 |
| 2012/0304553 | A1* | 12/2012 | Konduc | E21B 15/00<br>52/112 |
| 2014/0144362 | A1 | 5/2014 | Atkinson | |
| 2015/0210359 | A1 | 7/2015 | McClure | |

OTHER PUBLICATIONS

PCT Search Report and Written Opinion issued in corresponding PCT Application No. PCT/AU2017/050747 dated Nov. 2, 2017, 9 pages.

Written opinion of the International Preliminary Examining Authority issued in corresponding PCT Application No. PCT/AU2017/050747 dated Dec. 3, 2018, 5 pages.

Written Opinion of the International Preliminary Examining Authority issued in corresponding PCT application No. PCT/AU2017/050747 dated Jul. 18, 2018, 4 pages.

* cited by examiner

MAST BASE ASSEMBLY

TECHNICAL FIELD

The present invention relates broadly to a mast base assembly for a marine vessel and relates particularly, although not exclusively, to a mast base assembly of an unmanned surface vessel (USV).

SUMMARY OF INVENTION

According to the present invention there is provided a mast base assembly for a marine vessel, said assembly comprising:

a mast base mounting adapted to secure to the marine vessel;

a mast tilt assembly pivotally mounted to the mast base mounting about a tilt axis for movement of the mast tilt assembly between stowed and operative positions;

a sail slew assembly adapted to mount to a sail associated with the marine vessel, the sail slew assembly operatively coupled to the mast tilt assembly for slewing of the sail about a slew axis of the mast tilt assembly to reorient the sail relative to the marine vessel.

Preferably the sail slew assembly includes a mast slew gear fixed to a mast coupling to which a mast associated with the sail is fitted for slewing movement, the mast coupling mounted to the mast tilt assembly. More preferably the sail slew assembly also includes a sail slew gear mounted to the sail and operatively meshed to the mast slew gear for slewing of the sail. Even more preferably the sail slew gear includes a worm, and the mast slew gear is in the form of a worm gear to which the worm is meshed for slewing of the sail.

Preferably the sail slew assembly further includes a slew gear housing secured to a lower portion of the sail, said gear housing configured to contain the worm and an associated worm drive designed to effect its rotation for slewing of the sail. More preferably the slew gear housing is also configured to contain and rotate about the mast slew gear. Even more preferably the slew gear housing is located internally of and contoured with the lower portion of the sail.

Preferably the mast tilt assembly includes a lever connected to the mast coupling and operatively coupled to a tilt actuator for pivoting of the mast tilt assembly about the tilt axis of the mast base mounting. More preferably the tilt actuator includes a hydraulically-actuated cylinder connected at opposing ends to the lever and the mast base mounting, respectively. Even more preferably the tilt actuator pivots the mast tilt assembly and the associated mast and sail between the stowed and the operative positions in substantially horizontal and vertical orientations, respectively.

Alternatively the mast tilt assembly includes a mast tilt gear connected to the mast coupling and operatively meshed to an actuator gear for pivoting of the mast tilt assembly. In this alternative embodiment the actuator gear includes an actuator worm driven for rotation in both directions via a drive motor to effect pivoting of the mast tilt assembly and the associated sail between the stowed and operative positions.

Preferably the mast base assembly also comprises a mast bearing fitted internally of the mast to permit its slewing movement about the mast coupling. More preferably the mast bearing includes an annular bush fitted between the mast coupling and the mast.

Preferably the sail is a rigid wing sail. More preferably the rigid wing sail is in cross-section generally crescent-shaped. Even more preferably the crescent-shaped wing sail is formed in one-piece. Still more preferably the one-piece wing sail is of a foam sandwich construction.

Preferably the mast is tubular and located substantially mid-way between opposing longitudinal edges of the sail. More preferably the mast is formed integral with the sail. Even more preferably the integral mast is formed internally of the sail.

Alternatively the sail is a rigid wing sail including a pair of elongate rigid panels have an adjoining edge opposing a lateral edge. In this alternative embodiment the wing sail also includes a hinge element arranged to cooperate with the pair of rigid panels at their adjoining edges to permit pivotal movement of said rigid panels relative to one another. In this example the hinge element includes the mast associated with the sail. The sail slew assembly may include a pair of mast slew gears fixed to the mast coupling and dedicated to respective of a pair of sail slew gears mounted to respective of the pair of rigid panels for:

i) pivotal movement of the rigid panels relative to one another; and ii) slewing of the rigid wing sail relative to the marine vessel.

Preferably the marine vessel includes a deck mounted to a hull, the deck shaped substantially complementary to the sail which at least in part wraps about the deck with the mast tilt assembly in the stowed position. Alternatively or additionally the sail forms part of the deck of the marine vessel with the mast tilt assembly in the stowed position.

Preferably the marine vessel is an unmanned surface vessel.

BRIEF DESCRIPTION OF DRAWINGS

In order to achieve a better understanding of the nature of the present invention a preferred embodiment of a mast base assembly for a marine vessel will now be described, by way of example only, with reference to the accompanying drawings in which.

DETAILED DESCRIPTION

Figure 1:
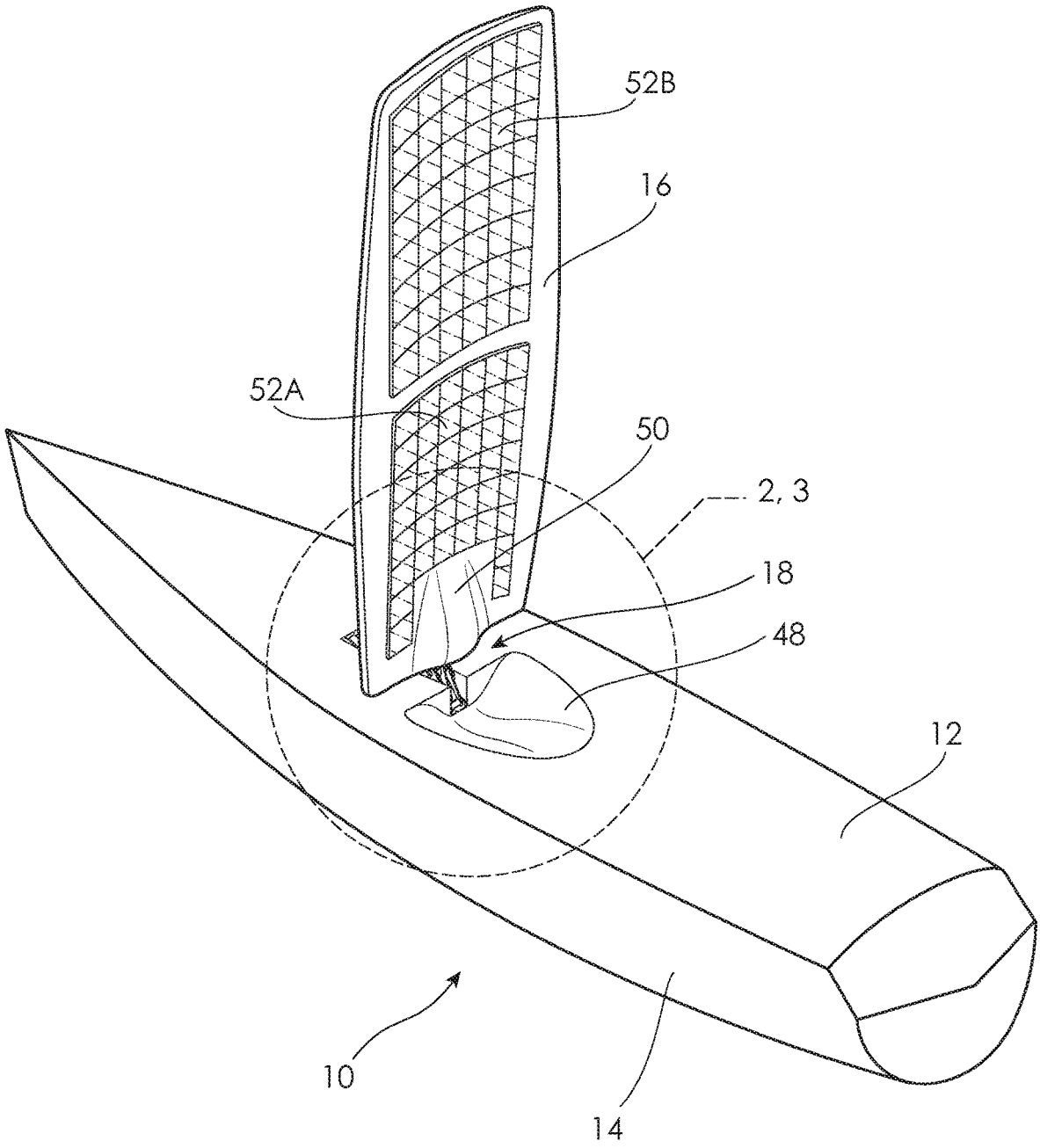
FIG. 1 is a perspective view of a marine vessel including a mast base assembly according to one embodiment of the invention.

As shown in FIG. 1 there is a marine vessel 10 generally comprising a deck 12 mounted to a hull 14 together with a sail 16 coupled to the marine vessel 10 via a mast base assembly 18. The mast base assembly 18 of this embodiment comprises a mast tilt assembly 22 (see FIGS. 2 to 6) shown in its operative position with the associated sail 16 in a substantially vertical orientation.

Figure 2:
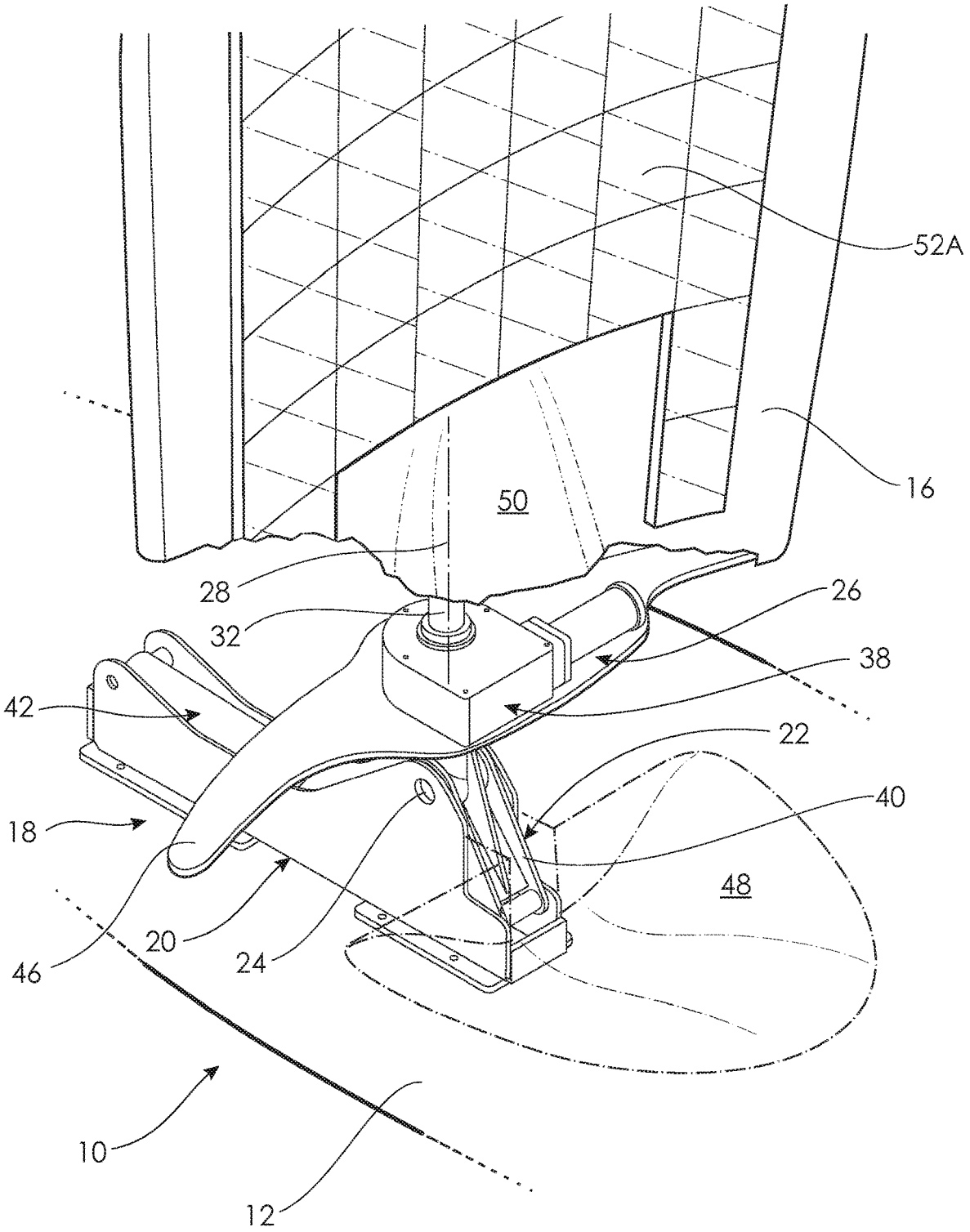
FIG. 2 is an enlarged perspective view of the mast base assembly and part of the sail of the embodiment of FIG. 1.
Figure 3:
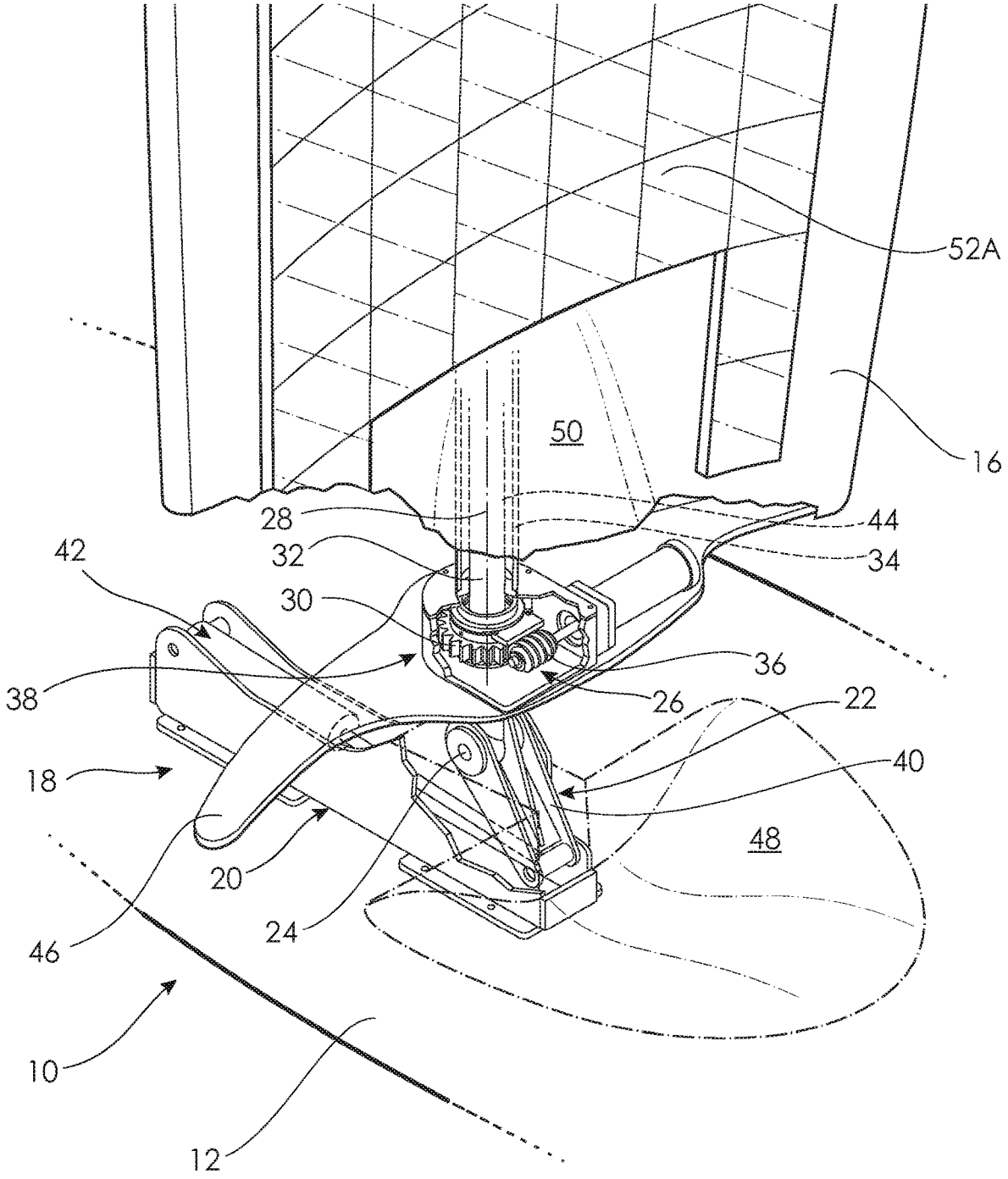
FIG. 3 is an enlarged perspective view showing the mast base assembly in part cutaway from the embodiments of FIGS. 1 and 2.

As best shown in FIGS. 2 and 3 the mast base assembly 18 also comprises a mast base mounting 20 to which the mast tilt assembly 22 is pivotally mounted for movement about a tilt axis 24 between stowed (see FIGS. 5 and 6) and operative positions (see FIGS. 1 to 4). The mast base assembly 18 further comprises a sail slew assembly 26 mounted to the sail 16 associated with the marine vessel 10. The sail slew assembly 26 is operatively coupled to the mast tilt assembly 22 for slewing of the sail 16. The sail 16 in this embodiment is rotated or slewed about a slew axis 28 of the mast tilt assembly 22 to reorient the sail 16 relative to the marine vessel 10.

As best seen in FIG. 3 the sail slew assembly 26 includes a mast slew gear 30 fixed to a mast coupling 32 to which a mast 34 associated with the sail 16 is fitted for slewing movement. The mast coupling 32 is in this embodiment in the form of a mast stub connected to the mast tilt assembly 22. The sail slew assembly 26 also includes a sail slew gear 36 mounted to the sail 16 and operatively meshed to the mast slew gear 30 for slewing of the sail 16. In this embodiment the sail slew gear 36 is in the form of a worm, and the mast slew gear 30 is in the form of a worm gear to which the worm 36 is meshed for slewing of the sail 16.

As best shown in FIG. 2 the sail slew assembly 26 further includes a slew gear housing 38 secured to a lower portion of the sail 16. The gear housing 38 is configured to contain the worm 36 and an associated worm drive (not shown) designed to effect its rotation for slewing of the sail 16. The slew gear housing 38 is also configured to contain and rotate about the mast slew gear 30 which is fixed to the mast stub 32. The slew gear housing 38 is located internally of and contoured with the lower portion of the sail 16 (see FIGS. 1 and 2).

Figure 4:
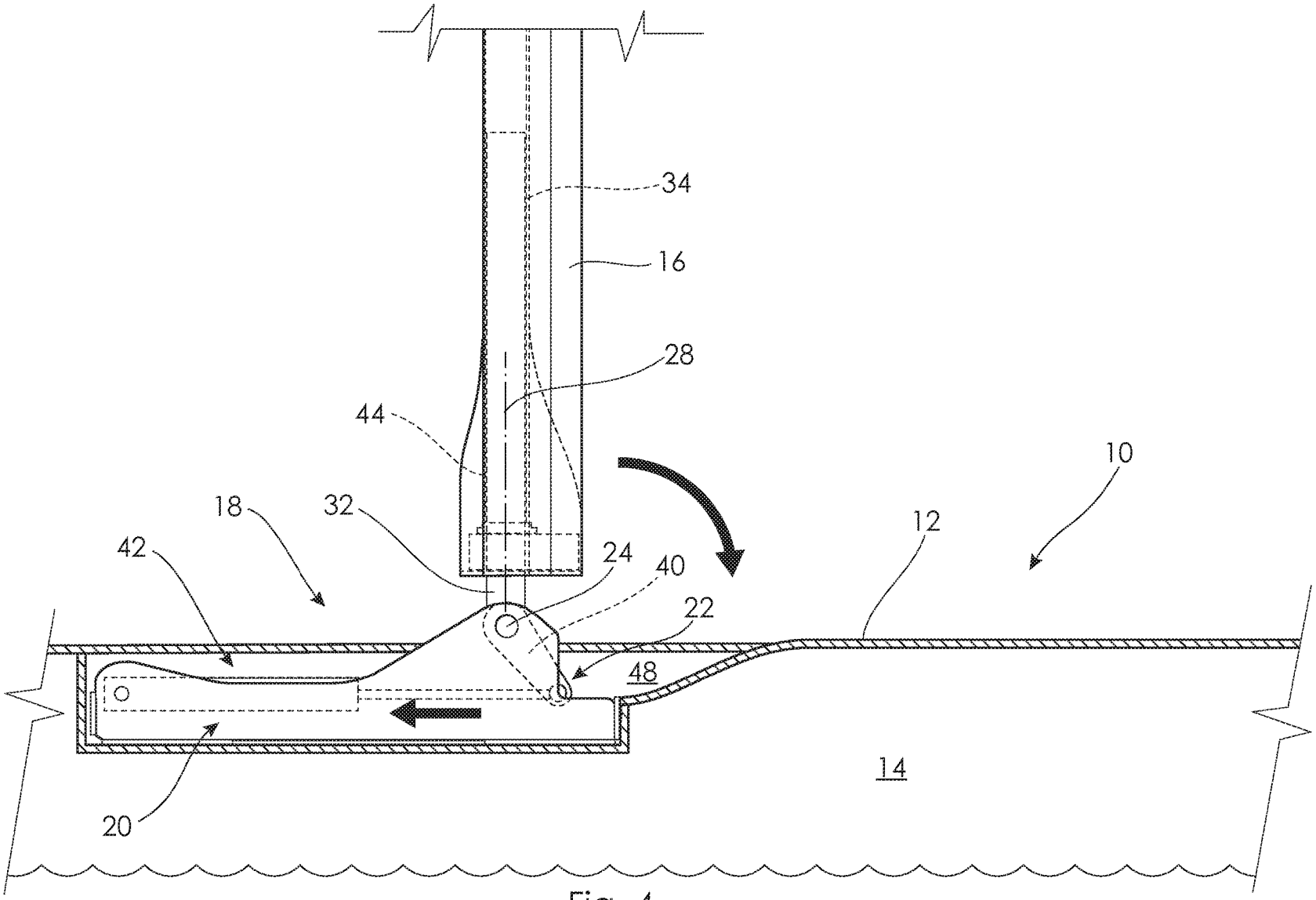
FIG. 4 is a part sectional view taken in side elevation of the mast base assembly and associated marine vessel of the embodiment of the preceding figures.

As best seen in FIG. 4 the mast tilt assembly 22 includes a lever 40 connected to the mast stub 32 and operatively coupled to a tilt actuator 42 for pivoting of the mast tilt assembly 22. The mast tilt assembly 22 pivots about the tilt axis 24 of the mast base mounting 20. In this example the tilt actuator 42 includes a hydraulically-actuated cylinder connected at opposing ends to the lever 40 and the mast base mounting 20, respectively. The tilt actuator or hydraulically-actuated cylinder 42 thus functions to pivot the mast tilt assembly 22 and the associated mast 34 and sail 16 between the stowed and the operative positions in substantially horizontal and vertical orientations, respectively.

As further illustrated in FIG. 4 the mast base assembly 20 also comprises a mast bearing 44 fitted internally of the mast 34 to permit its slewing movement about the mast stub 32. The mast bearing 44 is in this example in the form of an annular bush fitted between the mast stub 32 and the mast 34. The mast 34 is in this embodiment fixed to the sail 16 and designed to rotate about the mast stub 32 and the annular bush 44.

In this embodiment the sail 16 is a rigid wing sail of a foam sandwich construction. The rigid wing sail 16 is in cross-section generally crescent-shaped with a foam core and fibreglass skins on its exterior. The mast 34 is tubular and constructed predominantly of carbon fibre of a suitable modulus to provide the required flexural rigidity. Although not illustrated, the sail 16 in its lower portion may be reinforced and shaped to accommodate the sail slew assembly 26. The carbon fibre mast 34 is integral with the sail 16 and in this example located substantially mid-way between opposing longitudinal edges of the sail 16. The sail 16 may also include an end plate 46 for mounting and containment of the sail slew assembly 26.

Figure 5:
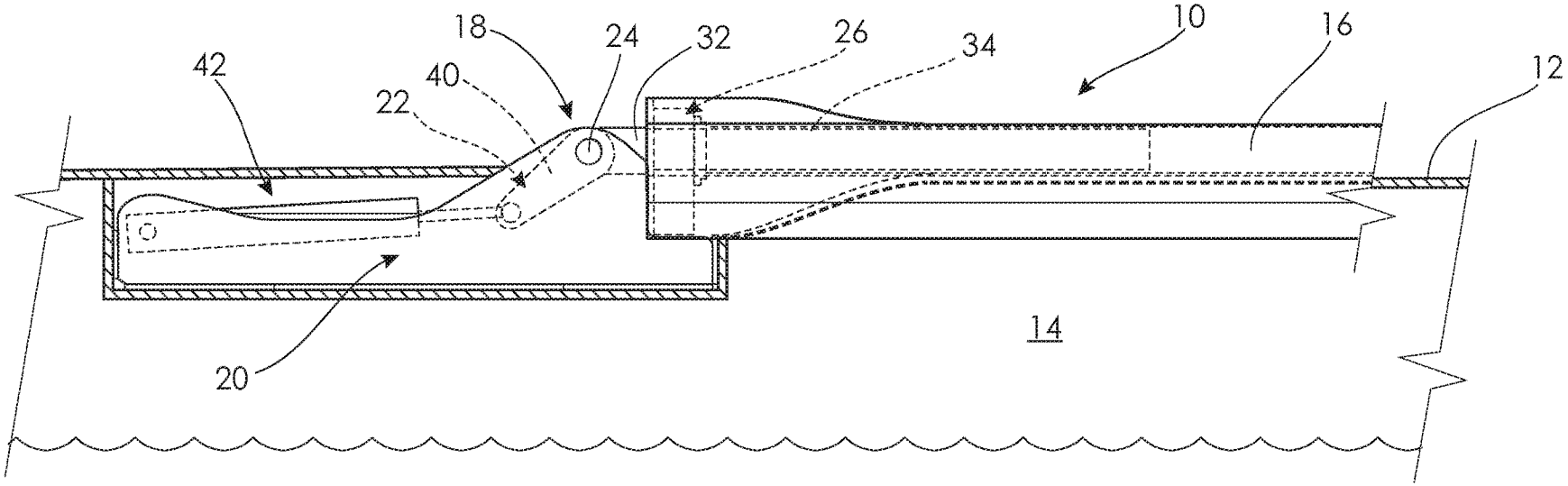
FIGS. 5 and 6 are side and rear elevational views respectively of the mast base assembly of the preceding embodiment with its mast tilt assembly in the stowed position.
Figure 6:
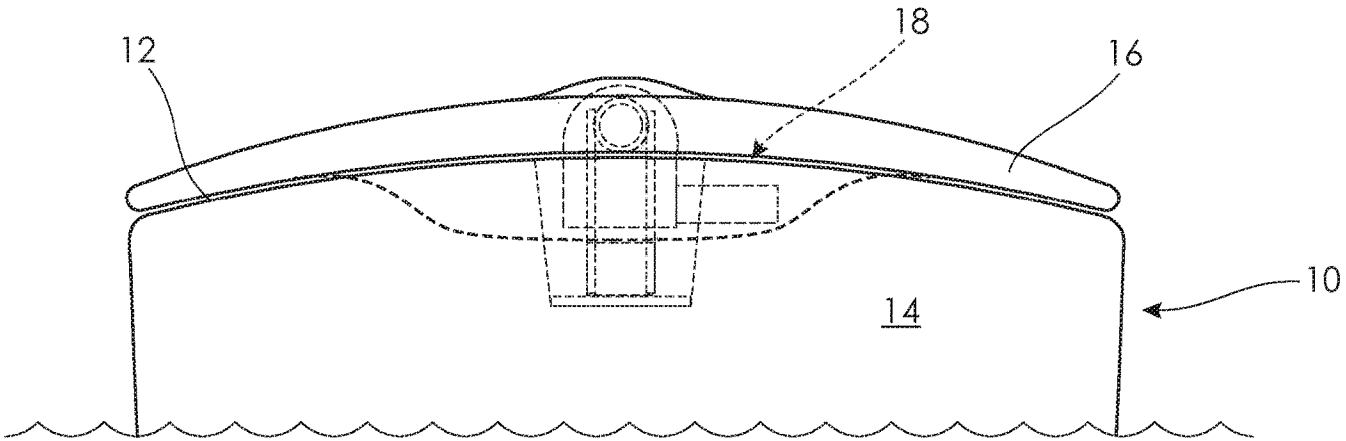

FIGS. 5 and 6 show the mast tilt assembly 22 in its stowed position where the concave side of the sail 16 effectively wraps about the deck 12 of the vessel 10. In this embodiment the deck 12 is at least partly shaped substantially complementary to the concave side of the sail 16 including a cup-shaped recess 48 which accommodates a protruding portion 50 of the sail 16 within which the sail slew assembly 26 is contained. The protruding portion 50 of the sail 16 nests within the recess 48 of the deck 12 when the mast tilt assembly 22 is in the stowed position with the associated mast 34 and sail 16 substantially horizontal.

The sail 16 may include one or more solar panels such as 52A and 52B mounted to its exterior surface for harnessing solar energy in providing supplementary power or charging for the marine vessel 10. Although depicted on the concave surface of the sail 16, the solar panels 52A/B may preferably be located on the convex surface of the sail 16 so that they are exposed to sunlight with the mast tilt assembly 22 in the stowed position with the associated sail 16 wrapping about the deck 12.

Figure 7:
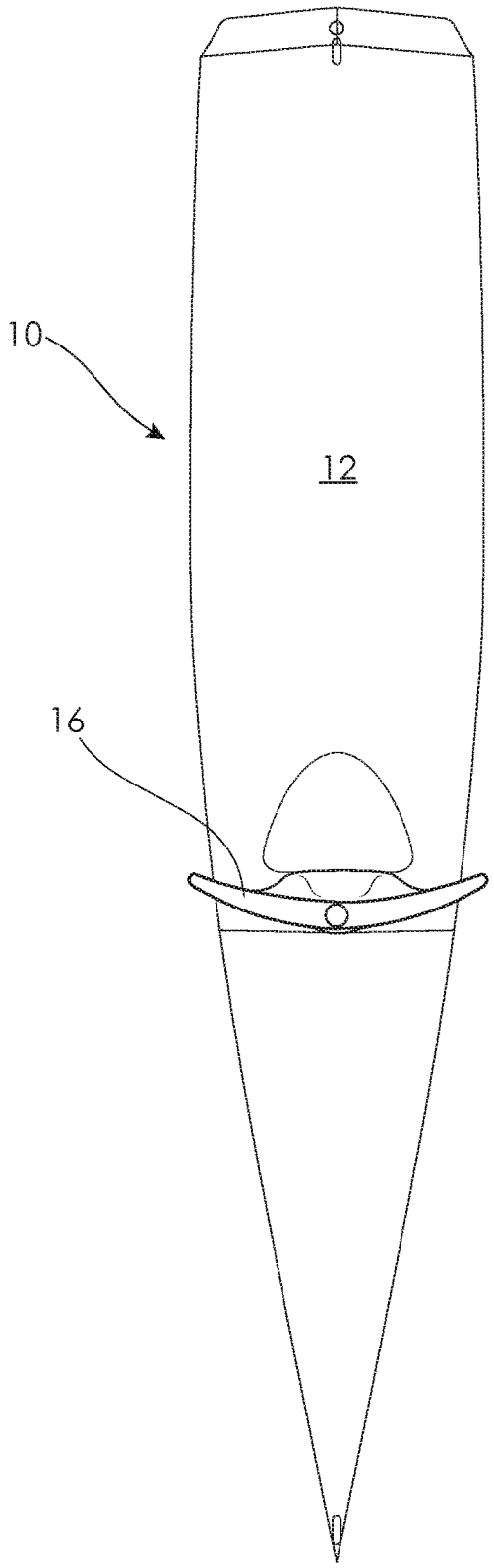
FIGS. 7 and 7*a* are plan views of the marine vessel of FIGS. 1 to 4 showing the mast tilt assembly in its operative position with the associated sail slewed at various angular dispositions.
Figure 7A:
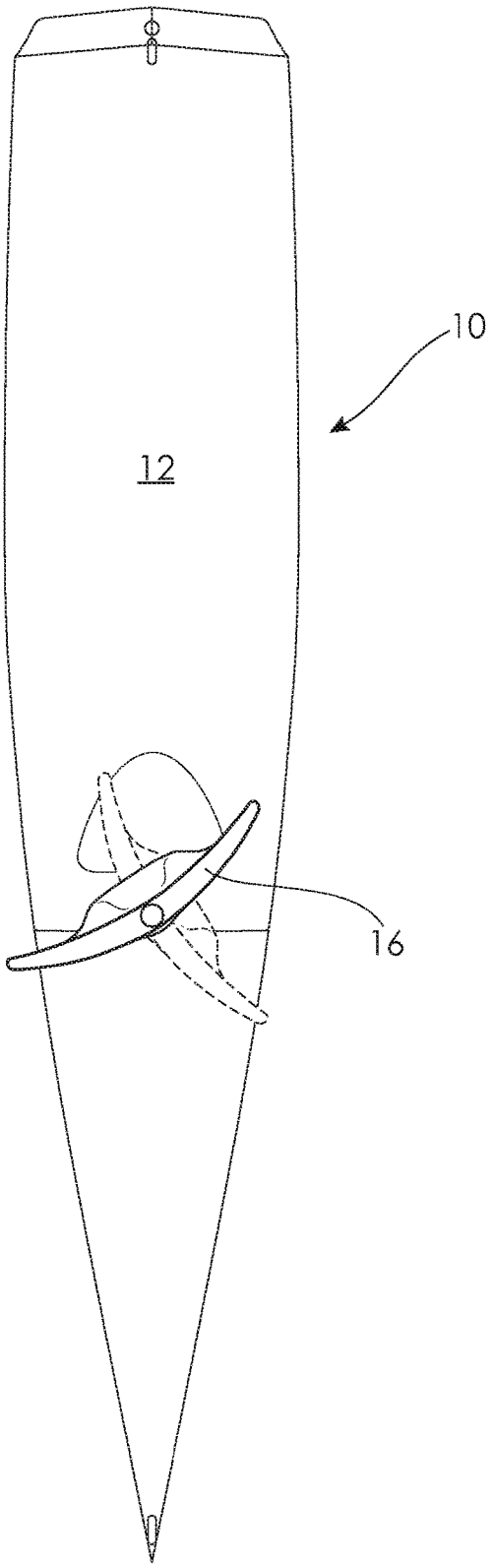
Figure 8:
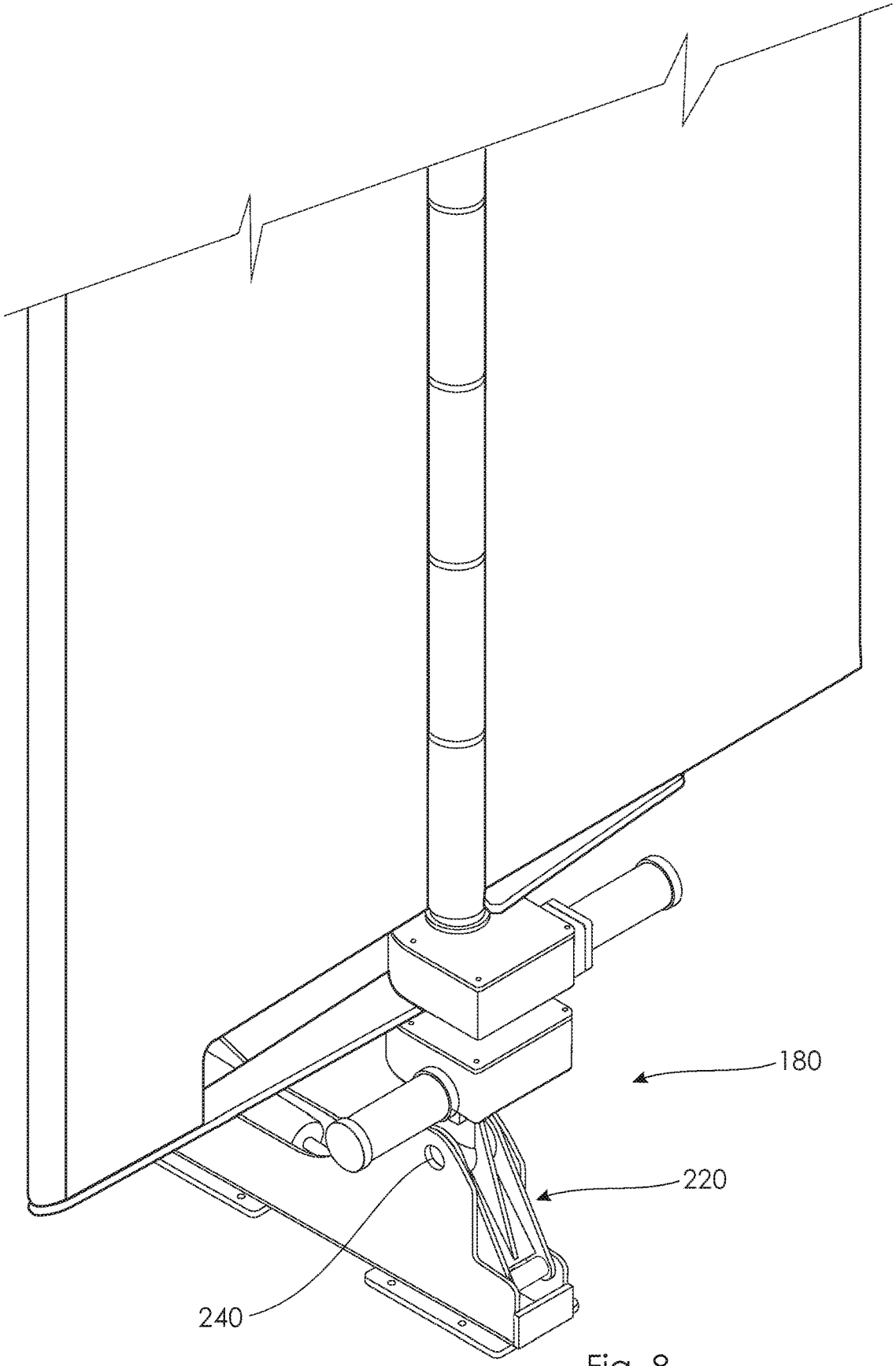
FIG. 8 is an enlarged perspective view of a mast base assembly and part of an associated sail according to another embodiment of the invention.
Figure 9:
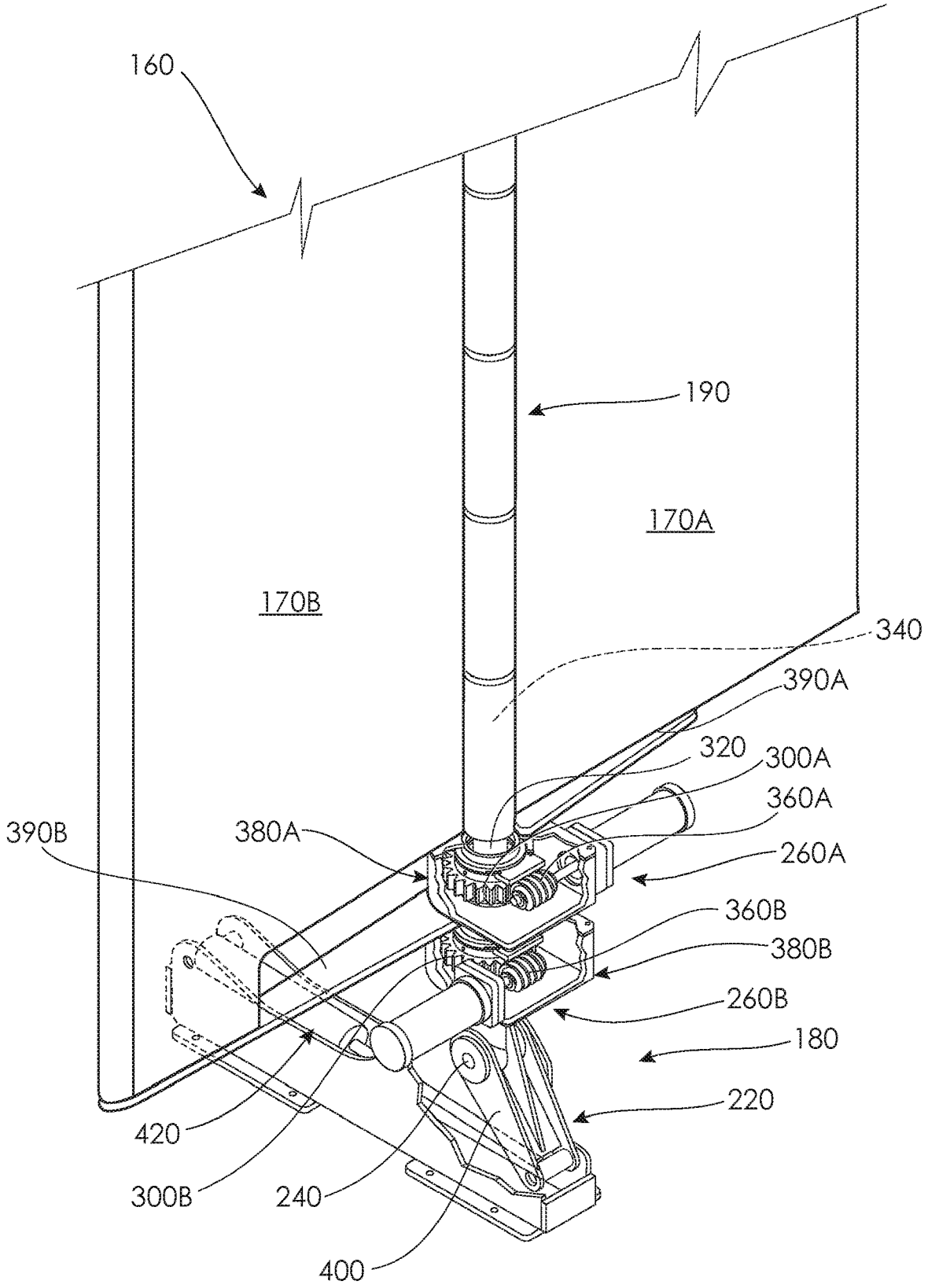
FIG. 9 is an enlarged perspective view showing the mast base assembly of the embodiment of FIG. 8 in part cutaway.
Figure 10:
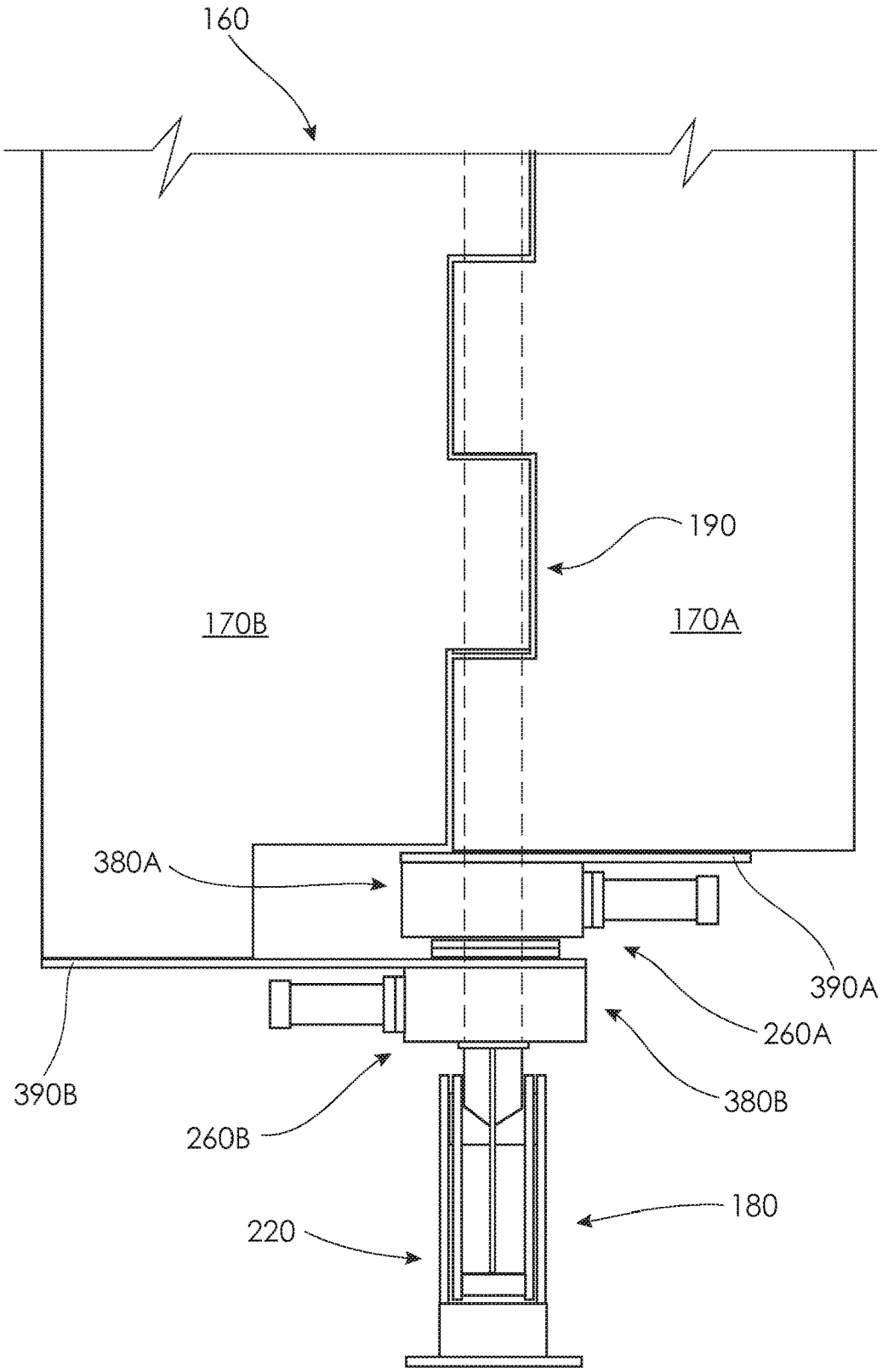
FIG. 10 is a rear elevational view of the mast base assembly of the embodiment of FIGS. 8 and 9.

FIGS. 7 and 7*a* show the marine vessel 10 with the associated sail 16 slewed at various angles depending on the wind direction relative to the vessel 10. The slew angle for the sail 16 relative to the vessel 10 depends primarily on the following factors:

1. the required direction of travel or sailing for the vessel 10 and thus the "tack" on which the vessel 10 sails;
2. the apparent angle of the wind to the vessel 10 which determines the angle of the sail 16 relative to the vessel 10.

FIG. 7 depicts the sail 16 at roughly right angles to the centreline of the vessel 10 and is generally appropriate with the wind from behind the vessel 10 thus presenting maximum surface area of the sail 16. FIG. 7*a* shows the sail 16 in solid line detail with the vessel 10 on starboard tack where the apparent wind angle is somewhere aft of the beam at an acute angle relative to the centreline of the vessel 10. FIG. 7*a* shows the sail 16 in broken line detail with the vessel on port tack with the apparent wind angle somewhere forward of the beam. In both dispositions of the sail 16 in FIG. 7*a* it has been slewed via the sail slew assembly 26 into the required or optimum angular position. It will be understood that an on-board processor is used to determine the required angular disposition of the sail 16 relative to the vessel 10 based on at least the following inputs:

1. the apparent angle of the wind relative to the vessel 10 derived from one or more wind sensors;
2. the direction of travel of the marine vessel, for example detected by GPS equipment.

Although not illustrated the mast base assembly 18 includes one or more position sensors designed to detect the position of the sail 16 relative to the vessel 10. The position sensors function in conjunction with the on-board processor to drive the sail slew assembly 26 so that the sail 16 is located at the optimum angular position. The positional sensors also ensure the sail 16 is in appropriate angular alignment for lowering onto the deck 12 to ensure the concave face of the sail 16 wraps about the deck 12 with the mast tilt assembly 22 in the stowed position. As can best be seen in FIGS. 4 and 5:

1. the mast tilt assembly 22 is lowered in conjunction with the associated mast 34 and sail 16 by retracting the hydraulically-actuated cylinder 42 for tilting of the mast 34 about the tilt axis 24 (see FIG. 4);
2. the hydraulically-actuated cylinder 42 when fully retracted serves to hold the mast tilt assembly 22 and the associated sail 16 in the horizontal orientation wrapped about the deck 12.

FIGS. 8 to 11 illustrate another embodiment of a mast base assembly 180 according to the present invention. The mast base assembly 180 of this other embodiment is to be fitted to a marine vessel such as a ship in the form of a bulk carrier. In this application the sail 160 provides fuel savings when "motor sailing" where the bulker remains on course and the sails 160 reduce fuel consumption whilst maintaining the same speed.

For ease of reference and in order to avoid repetition, the components of this alternative embodiment which are effectively the same as the preceding embodiment have been designated with an additional "0". For example, the mast tilt assembly of this other embodiment has been designated as 220. The mast base assembly 180 of this other embodiment is substantially similar to the preceding embodiment except:

1. the mast coupling or stub 320 is provided with a pair of mast slew gears 300A and 300B;
2. the sail 160 includes a pair of elongate rigid panels 170A and 170B pivotally hinged to one another via a hinge element 190 which includes the mast 340 associated with the sail 160;
3. a pair of sail slew gears 360A and 360B are mounted to respective of the rigid sail panels 170A and 170B and operatively meshed to respective of the mast slew gears 300A and 300B.

In this alternative embodiment the sail slew assembly 260 operates to provide either:

1. pivotal movement of the rigid sail panels 170A/B relative to one another; or
2. slewing of the rigid wing sail 160 by synchronised actuation of the pair of sail slew gears 360A/B.

Figure 11A:
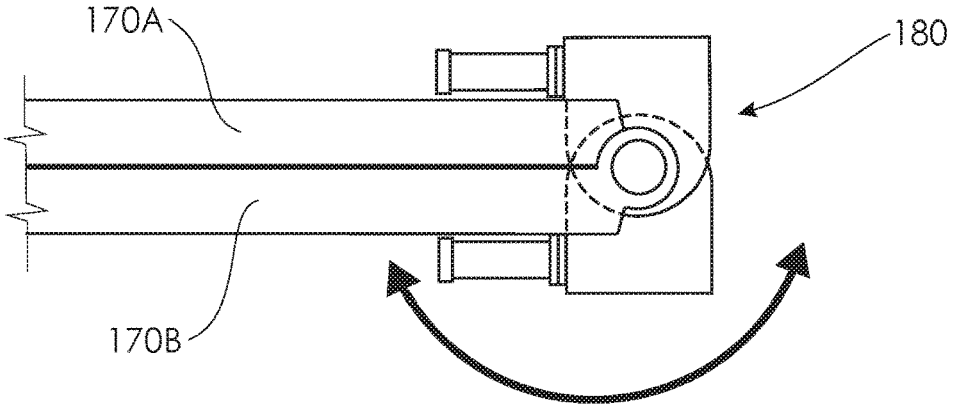
FIG. 11 shows various plan views of the mast base assembly and part of the associated sail of the embodiment of FIGS. 8 to 10 with the pair of rigid panels oriented at different angles relative to one another.
Figure 11B:
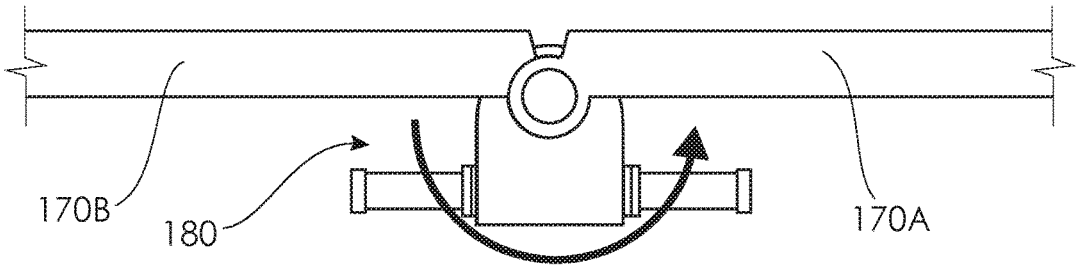
Figure 11C:
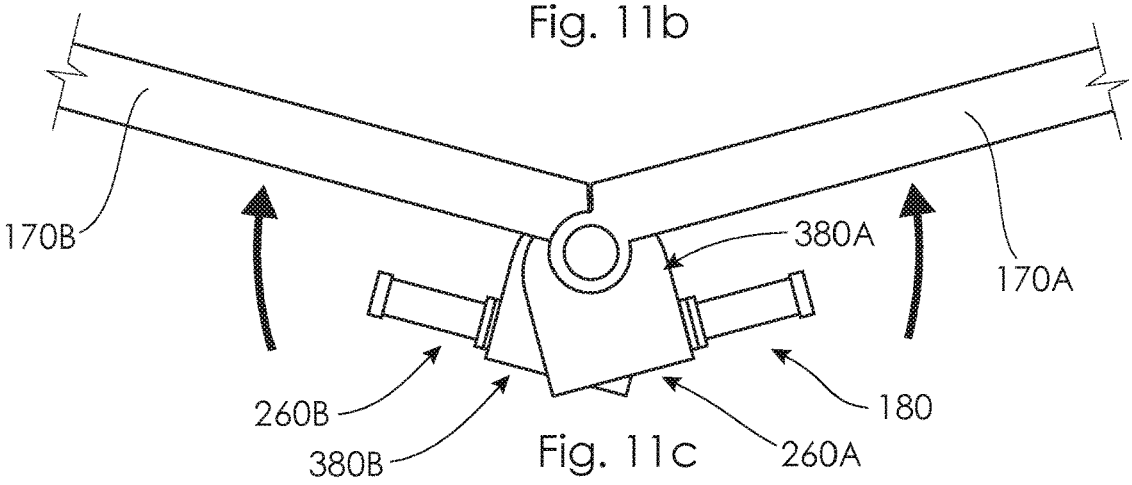
Figure 11D:
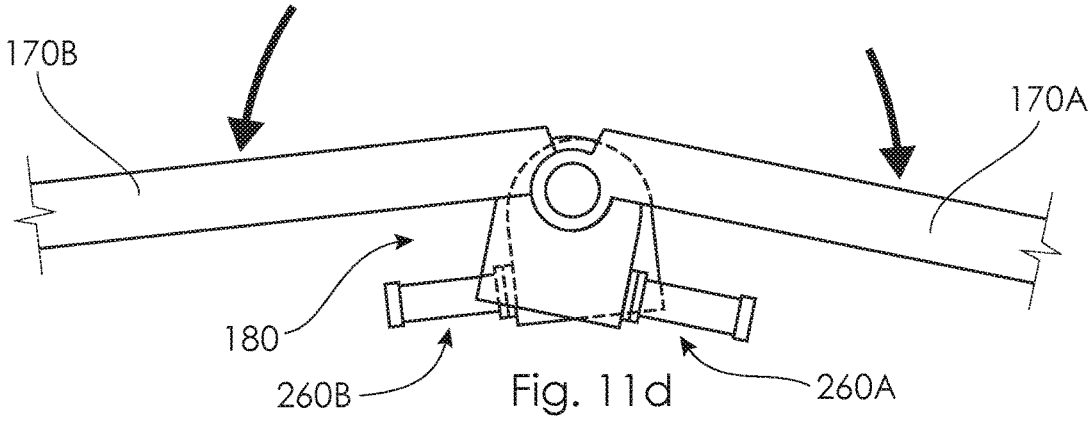

The relative pivotal movement of the rigid sail panels 170A/B effectively reshapes the sail 160 depending on for example the wind direction relative to the marine vessel. The reshaping of the sail 160 may be effected in the course of a tack by "breaking theback" of the sail 160 where its concave face on one tack changes to its convex face on an opposite tack. Unlike the preceding embodiment, the sail 160 need only be slewed through a relatively small angle when tacking, say around 30 to 80 degrees. The sail 160 as shown in FIGS. 11*a* and 11*b* may be fully closed or opened, respectively, where for example the sail 16 may be stowed in this compact orientation. For example, the sail 160 may be "feathered" or stowed in the event of no wind, head winds, or excessive wind/seas. These varied configurations of the sail 16 are further described in the applicant's international patent application no. PCT/AU2013/001153. The disclosure of this PCT application is to be considered incorporated herein by reference.

Returning to FIGS. 8 to 10 each of the slew gear housings 380A and 380B is mounted or otherwise secured to a lower region of the associated rigid panel 170A or 170B respectively. In this example each of the slew housings 380A and 380B is provided with a bracket 390A or 390B which is fastened to the corresponding rigid panel 170A or 170B. This means that actuation of for example the sail slew gear 360A associated with the rigid panel 170A drives that panel 170A around the mast slew gear 300A to which it is dedicated. The sail 16 may be reshaped by actuation of one or both of the sail slew gears 360A or 360B.

In this other embodiment the rigid panels such as 170A and 170B are substantially planar or flat. The flat panels such as 170A may be fabricated in one-piece from metal sheet or plate, such as steel or aluminium. The rigid panels 170A and 170B at their adjoining edges resemble a "piano hinge" interlocked by the mast 340.

Now that a preferred embodiment of a mast base assembly has been described it will be apparent to those skilled in the art that it has the following advantages:

1. it provides a relatively uncomplicated mechanism for both tilting of the mast and slewing of the associated sail;
2. the mast tilt assembly and the sail slew assembly are operated independent of one another which provides some form of redundancy in the system;
3. the mast tilt assembly is relatively compact and easy to mount to the vessel whilst providing sufficient power to raise and lower the associated sail;
4. the sail slew assembly can be incorporated within the design of the sail itself without largely compromising the aerodynamic features of the sail.

Those skilled in the art will appreciate that the invention as described herein is susceptible to variations and modifications other than those specifically described. For example, the mast tilt assembly may include a mast tilt gear connected to the mast coupling and operatively meshed to an actuator gear for pivoting of the mast tilt assembly. In this alternative embodiment the actuator gear may be in the form of an actuator worm driven for rotation in both directions via a drive motor to effect pivoting of the mast tilt assembly and the associated sail between the stowed an operative positions. The deck of the marine vessel may in part be completed by the sail in its lowered or horizontal orientation where in effect the sail forms part of the deck of the vessel. All such variations and modifications are to be considered within the scope of the present invention the nature of which is to be determined from the foregoing description.

The invention claimed is:

1. A mast base assembly of an unmanned surface vessel, said mast base assembly comprising:

a mast base mounting adapted to secure to the unmanned surface vessel;

a mast tilt assembly including a mast coupling pivotally mounted to the mast base mounting about a tilt axis for movement of the mast tilt assembly between stowed and operative positions;

a sail fitted to the mast coupling for slewing about the mast coupling;

a sail slew gear including a worm associated with a worm drive mounted to the sail;

a mast slew gear in the form of a worm gear fixed to the mast coupling and operatively meshed to the worm which on rotation via the worm drive effects slewing movement of the sail together with the sail slew gear about the mast coupling to reorient the sail relative to the unmanned surface vessel;

a slew gear housing secured to a lower portion of the sail, said gear housing configured to i) contain the worm and the associated worm drive, and ii) to contain and rotate about the mast slew gear.

2. The mast base assembly as claimed in claim 1 wherein the slew gear housing is located internally of and contoured with the lower portion of the sail.

3. The mast base assembly as claimed in claim 1 wherein the mast tilt assembly includes a lever connected to the mast coupling and operatively coupled to a tilt actuator for pivoting of the mast tilt assembly about the tilt axis of the mast base mounting.

4. The mast base assembly as claimed in claim 3 wherein the tilt actuator includes a hydraulically-actuated cylinder connected at opposing ends to the lever and the mast base mounting, respectively.

5. The mast base assembly as claimed in claim 3 wherein the tilt actuator pivots the mast tilt assembly and the mast coupling and sail between the stowed and the operative positions in substantially horizontal and vertical orientations, respectively.

6. The mast base assembly as claimed in claim 1 wherein the mast tilt assembly includes a mast tilt gear connected to the mast coupling and operatively meshed to an actuator gear for pivoting of the mast tilt assembly.

7. The mast base assembly as claimed in claim 6 wherein the actuator gear includes an actuator worm driven for rotation in both directions via a drive motor to effect pivoting of the mast tilt assembly and the associated sail between the stowed and operative positions.

8. The mast base assembly as claimed in claim 1 wherein the mast base assembly also comprises a mast bearing associated with the sail to permit its slewing movement about the mast coupling.

9. The mast base assembly as claimed in claim 8 wherein the mast bearing includes an annular bush fitted between the mast coupling and the sail.

10. The mast base assembly as claimed in claim 1 wherein the sail is a rigid wing sail.

11. The mast base assembly as claimed in claim 10 wherein the rigid wing sail is in cross-section generally crescent-shaped.

12. The mast base assembly as claimed in claim 11 wherein the crescent-shaped wing sail is formed in one-piece.

13. The mast base assembly as claimed in claim 12 wherein the one-piece wing sail is of a foam sandwich construction.

14. The mast base assembly as claimed in claim 1 wherein the mast is tubular and located substantially mid-way between opposing longitudinal edges of the sail.

15. The mast base assembly as claimed in claim 14 wherein the mast is formed integral with the sail.

16. The mast base assembly as claimed in claim 15 wherein the integral mast is formed internally of the sail.

17. The mast base assembly as claimed in claim 1 wherein the unmanned surface vessel includes a deck mounted to a hull, the deck shaped substantially complementary to the sail which at least in part wraps about the deck with the mast tilt assembly in the stowed position.

18. The mast base assembly as claimed in claim 17 wherein the sail forms part of the deck of the marine vessel with the mast tilt assembly in the stowed position.

* * * * *